United States Patent [19]

Carrus et al.

[11] 3,931,761

[45] Jan. 13, 1976

[54] METHOD OF CONTINUOUS PRINTING OF DOCUMENTS

[76] Inventors: André Carrus; Pierre A. Carrus; Jacques H. Carrus, all of 30 rue des Petits Hotels, 75010 Paris, France

[22] Filed: Aug. 30, 1973

[21] Appl. No.: 392,933

Related U.S. Application Data

[63] Continuation-in-part of Ser. No. 186,676, Oct. 5, 1971, abandoned.

[30] Foreign Application Priority Data

| | | |
|---|---|---|
| Oct. 9, 1970 | France | 70.36558 |
| Apr. 14, 1971 | France | 71.13063 |
| May 5, 1971 | France | 71.16136 |

[52] U.S. Cl. ..... 101/66; 197/1 R; 340/172.5; 346/74 S

[51] Int. Cl.[2] ..... B41L 45/00

[58] Field of Search ..... 197/1 R; 101/93 C, 66–69; 340/172.5; 235/61.1, 61.12 R; 346/76 R, 74 S

[56] References Cited

UNITED STATES PATENTS

| | | | |
|---|---|---|---|
| 3,109,058 | 10/1963 | Luhn | 197/1 R |
| 3,124,674 | 3/1964 | Edwards et al. | 235/61.1 |
| 3,160,095 | 12/1964 | Lvby | 101/227 |
| 3,255,692 | 6/1966 | Hohmann | 101/66 |
| 3,300,017 | 1/1967 | Yazejian et al. | 197/1 R |
| 3,405,392 | 10/1968 | Milne et al. | 197/1 R X |
| 3,460,474 | 8/1969 | Follis et al. | 101/227 |
| 3,505,646 | 4/1970 | Affel et al. | 340/172.5 |
| 3,512,158 | 5/1970 | Scarbrough | 346/76 R |
| 3,596,256 | 7/1971 | Alpert et al. | 340/172.5 |
| 3,757,685 | 9/1973 | Woodie et al. | 101/66 |
| 3,774,530 | 11/1973 | Woodie et al. | 101/66 |

*Primary Examiner*—Edgar S. Burr
*Assistant Examiner*—R. T. Rader
*Attorney, Agent, or Firm*—Cantor & Kraft

[57] ABSTRACT

A process and printer are described for the rapid printing of documents, wherein the paper is continuously moved in front of static pinpoint printing heads covering the entire section of the printing surface, transverse to the direction of movement of the paper, and the printing heads are controlled by coded pulses. The printed document is legible by the naked eye and at the same time directly assimilable by machine. Certain characters may be selected, and simultaneously printed on the documents. Printing may be done by electric-spark perforation of an opaque conductive support tape, and thereafter examined by observation in transparency of the illuminated perforations.

5 Claims, 17 Drawing Figures

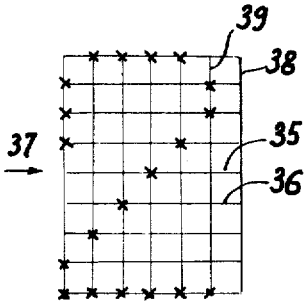
FIG. 3
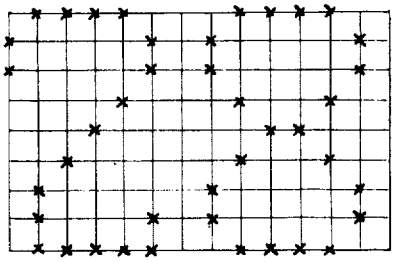
FIG. 4
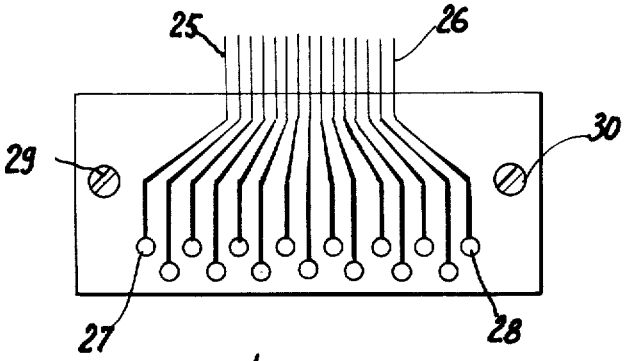
FIG. 7
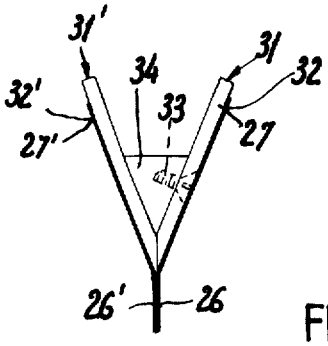
FIG. 8
FIG. 5
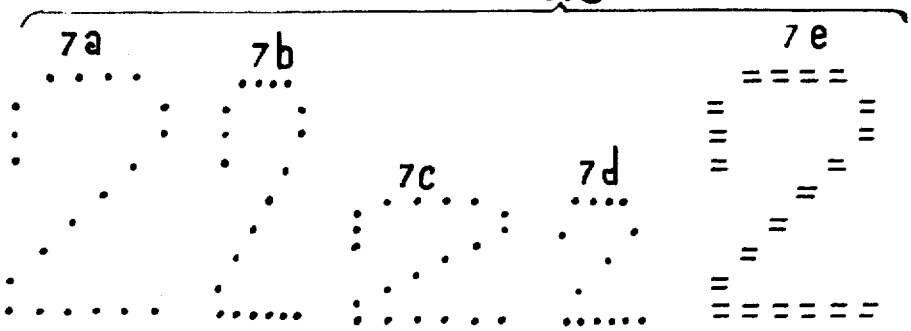

XV
208
217
216
205'
211
202
218
225
222
226
212
234
230
206
239
231
242
235
201
233
221
236
238
237
243
XV 217
216
212
211
205'
223
214
213
215
205'
219
220
234
226
225
XVI
205
235
232
236
244
208
210
202
207
238
221
206
233
220
243
245
201

XV
208
217
205'
215
216
218
225
202
231
222
230
201
205
212
210
219
207
206

XVI
235
234
230
225
206
XV
223
224
233
205'
207
228
222
215
236
205'
227
219
216
209
208
XV
XV
238
232
217
226
237
205'
242
218
211
201
205
202
239
229
240
231
241
XVII

METHOD OF CONTINUOUS PRINTING OF DOCUMENTS

The present application is a continuation-in-part of U.S. patent application Ser. No. 186,676 filed Oct. 5, 1971, now abandoned.

BACKGROUND OF THE INVENTION

The invention relates to a high-speed printing machine for use in electronic booking, reservation, or wager transaction systems comprising a plurality of vending stations at different locations for collecting and reproducing the particulars of booking or wager informations and, more particularly, it relates to a high-speed printing machine adapted to operate in a totalisator system such as used in connection with horse-racing, team competitions and the like.

Totalisators as presently known in the art operate with a great number of ticket printing and issuing machines or ticket validating machines comprising means for sensing the significance of perforation marks or notches to be initially formed by the bettor in a blank card and corresponding to the particulars of a selected bet, and means for printing said particulars on a ticket to provide the bettor with a record of the registered bet. However, the known ticket printing and issuing machines as well as the known ticket validating machines do not offer an entirely satisfactory protection against counterfeiting, and the handling of wagers on such complex bet combinations and formulae as a bet on the first three horses of the race, or a bet on a combination of four horses calls for the uttermost speed and reliability of the totalisator system.

One object of this invention is to provide an automatic high-speed printing machine for use in electronic booking or wager transaction systems.

It is another object of the invention to provide automatic recognition of ticket identity and of informations printed thereon to allow automatic payment of winning bets.

It is also an object of this invention to provide an automatic high-speed ticket printing and issuing machine for use in an electronic totalisator system and capable of reproducing any encoded wager informations in a legible and non falsifiable form.

It is a further object of this invention to provide two associated high-speed printing machines for use in connection with an electronic totalisator system, one of said machines being designed for printing and issuing betting tickets, and the other machine being designed for recording and displaying the amount of money to be paid for winning tickets.

BRIEF DESCRIPTION OF THE DRAWINGS

Other objects and advantages of the invention will become more apparent from the following specification, appended claims and accompanying drawings wherein:

FIGS. 3 and 4 illustrate different forms of dot matrix;

FIG. 5 illustrates different selective character sizes;

FIGS. 7 and 8 show details of a printing head;

DETAILED DESCRIPTION OF THE PREFERRED EMBODIMENTS

The high-speed ticket printing and issuing machine which forms one of the primary features of the invention is contemplated for use in booking, reservations, and more particularly in betting ticket vending stations at different locations and operates by means of electronic components designed for collecting and processing coded booking, reservation, or betting instructions under the control of a programmable processor within the ticket vending station and/or the central computer station which checks and evaluates the coded instructions received from the vending stations.

Figure 1:
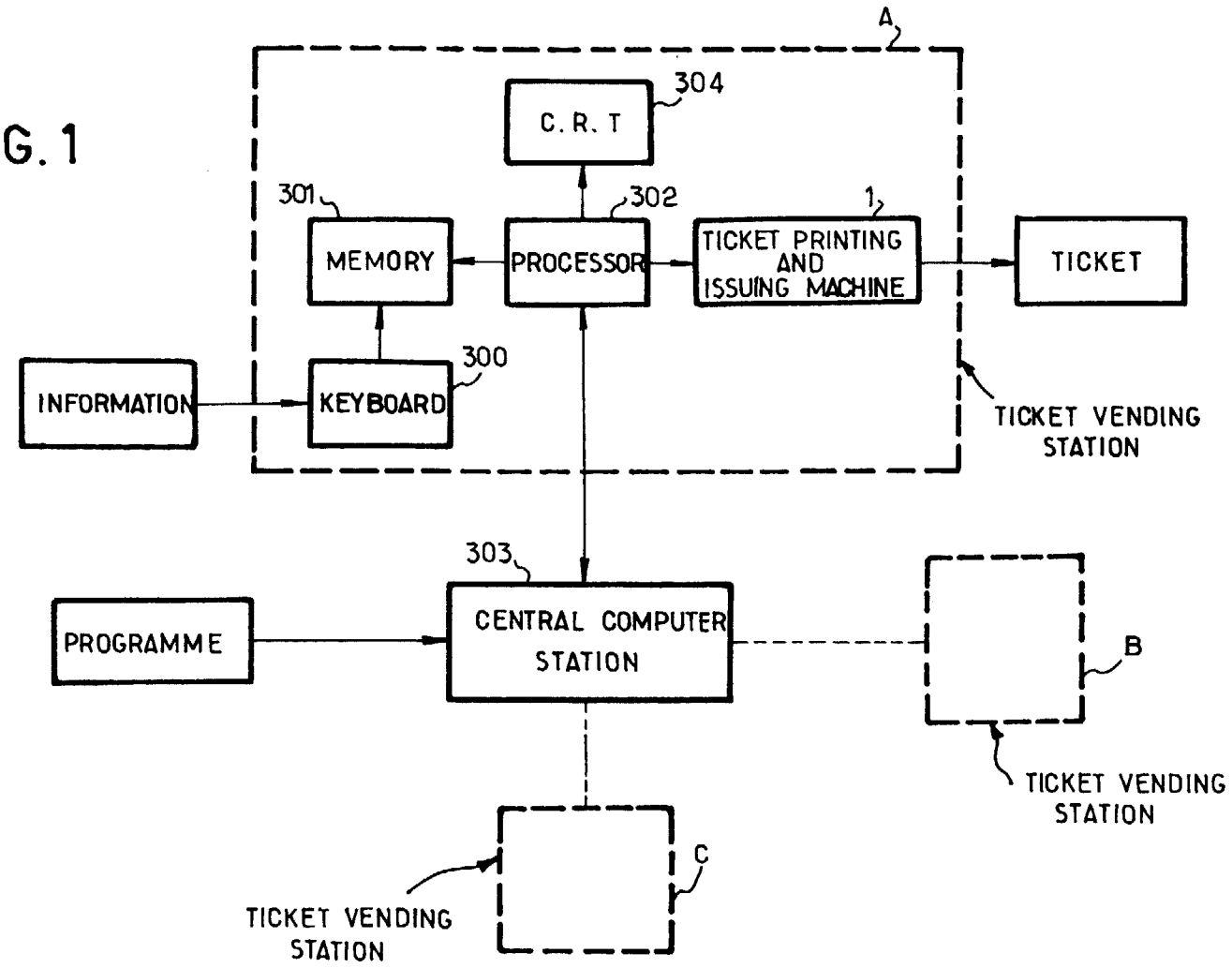
FIGS. 1 and 2 are schematic diagrams of an electronic totalisator system comprising a plurality of ticket vending stations at different locations.

FIG. 1 shows the invention as applied to an electronic totalisator system comprising a central computer station 303, and any suitable number of ticket vending stations such as indicated at A, B and C. Since the character transmission from a reader or a keyboard encoder to a recorder is known in the art, only those parts of the system are disclosed in the drawings which are required for a clear understanding of the invention.

Each ticket vending station such as A comprises input means such as, for example, an alphanumeric keyboard 300, a memory 301 for storing the selected keyboard characters, a data processor 302 for processing the keyboard characters taken from the memory 301, and a ticket printing and issuing machine 1. For each keyboard character selected by the operator and stored in the memory 301, the processor 302 transmits electrical signals representing the selected character to the computer station 303 in which said signals are automatically checked and recorded, and from which the processor is instructed to pass the checked and recorded signals to the ticket printing and issuing machine 1 which converts said signals into a legible printed character corresponding to the selected keyboard character. More specifically, the processor 302 produces electrical signals corresponding to the digits in a coded representation of each selected character, and the ticket printing and issuing machine 1 operates as a matrix printer which prints the transmitted characters in the form of a dot raster, the processing means including a storage matrix having a number of cores equal to the number of possible dots in the raster and arranged in columns or scanning lines and in rows or sweep lines such as disclosed in the IBM Technical Disclosure Bulletin, February 1965, Vol. 7, N° 9, pages 815–816. In accordance with conventional electronic circuitry also shown in said Bulletin, each column is threaded by separate column or scan conductors connected to read drivers, and each row is threaded by separate row or sweep conductors connected through And's to individual operators of print wires connected to printing electrodes assembled in the print head of the machine 1 which prints the individual scan lines of the dot raster in succession on an electrosensitive tape caused to advance relative to said electrodes, as will be later described in more detail. In order to permit a selective printing of characters having different sizes, a reduced number of sweep conductors are also connected to a second set of And's through a corresponding number of Or's, to a correspondingly reduced number of said print wire operators. For reproducing a character, certain cores are threaded by a write winding connected to a write driver having an input from a decoder clock, and for writing a character in the matrix, said writing winding is pulsed by a write driver as said scan conductors are addressed and pulsed by the read drivers under the control of another clock. For readout, the scan conductors are pulsed by the read drivers under control of said decoder clock in synchronism with the movement of said tape as the same is fed past said printing electrodes of machine 1. For printing large size characters, a matrix select pulse is applied to a conductor connected to the And's, and as the read drivers scan the column conductors, pulses in the sweep line conductors are supplied through the And's directly or through the Or's to said print wire operators. If it is desired to print characters of reduced size, the read drivers pulse only an odd series of scan line conductors in synchronism with the incremental advance of the tape to thereby reduce the width of the characters, and the matrix select pulse may be applied at the same time to a conductor connected to said second set of And's so that only said reduced number of sweep line conductors supply pulses through said Or's to said reduced number of operators to thereby reduce the height of the characters.

FIG. 3 shows a matrix operating in the above described manner, and in which the cores required to reproduce, for example, the number 2 are switched-on. This matrix comprises nine sweep lines such as 35, 36 in the direction of printing indicated by arrow 37, and seven scanning lines, such as 38, 39, perpendicular to the sweep lines. In such a matrix, the last scanning line 38 serves to space successive characters, and has no cores.

In binary code with such a matrix, the numeral 2 is thus read in the direction of the arrow 37 and in binary code the various cross-over points of the sweep and scan lines are energised in the following manner:

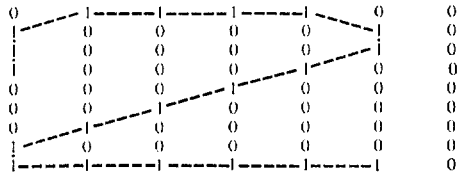

FIG. 4 shows a double matrix similar to that in FIG. 3 and representing the numeral 28. It should be noted, that on this matrix, the numeral 2 has not the same configuration as on the matrix in FIG. 3. Such an arrangement enables numerals printed singly to be differentiated from numerals printed in pairs, and this can have the advantage of avoiding frauds on documents since a forger cannot change the number 2 into 28.

The different sizes of a printed character obtainable by means of the above described selective operation of the print wires effected through the matrix are illustrated in FIG. 5, according to which the same character may have a normal size as shown at *7a*, or a reduced width as shown at *7b*, or a reduced height as shown at *7c*, or preferably a reduced width and a reduced height as shown at *7d*. It is also possible to connect to each print wire operator two print wires in parallel so as to obtain printed characters composed of double dots as shown at *7e* in FIG. 5.

The totalisator system further comprises arrangements by means of which the transmission of data relative to the particulars of a selected bet is preceded by an automatic transmission of system data including the number of the race, the special code of the day, the number pertaining to the vending station, and the serial number of the ticket, said data being reproduced in the form of legible characters and simultaneously in the form of marginal bits which could reproduce some selected informations printed in clear.

The totalisator system of FIG. 1 may also comprise facilities for preventing errors due to a false input signal, and the processor may include a display arrangement such as, for example, a display equipment which can energize a cathode ray tube 304 to display the selected characters on its screen in a legible form.

Figure 6:
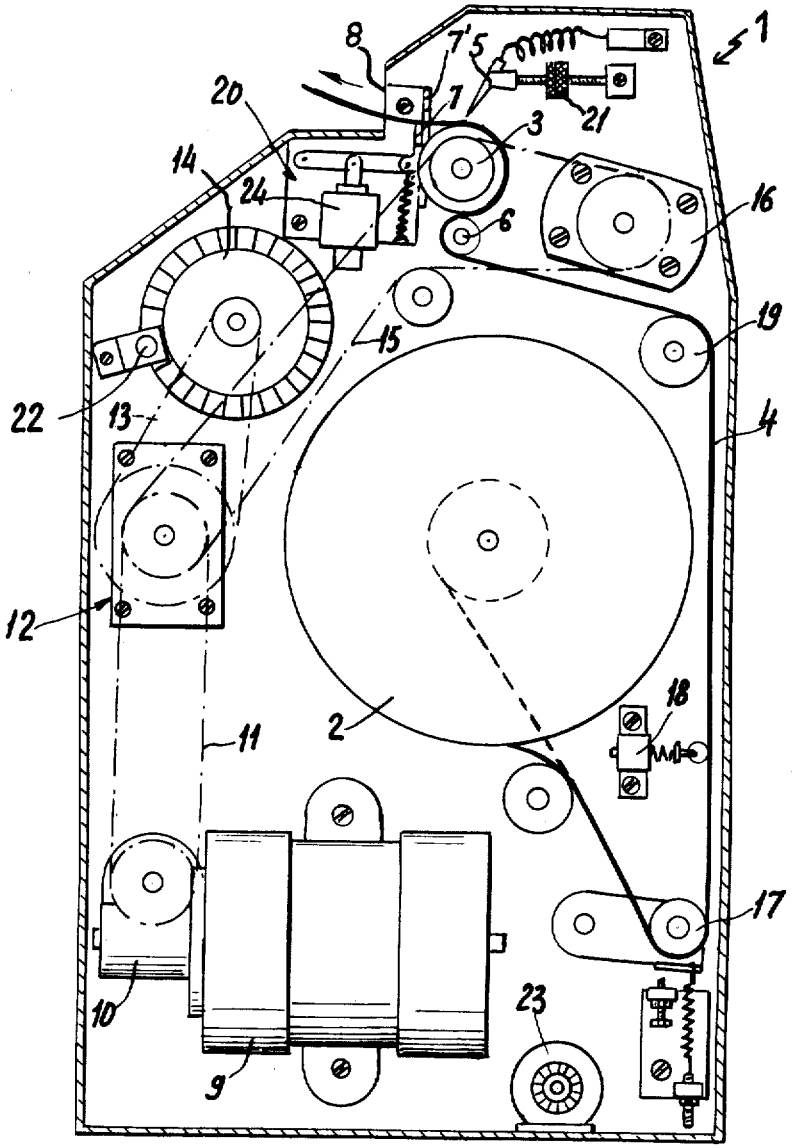
FIG. 6 is an elevational view of the ticket printing and issuing machine.

As shown in FIG. 6, the ticket printing and issuing machine 1 comprises an electric motor for driving a tape feed roller 3 through a reduction gear 10, a transmission belt 11, an electromagnetically operable clutch device 12, and a second transmission belt 15 which also passes over the roller of an electromagnetically operable braking device 16. A third transmission belt 13 provides a drive connection between the clutch device 12 and the rotatable disc 14 of a tachometric synchronizing device.

For printing out the coded informations in the form of legible characters, the printing head of the ticket printing and issuing machine 1 comprises a bench 5 of resilient and selectively energisable printing electrodes or styli, at least one for each sweep line of the previously described matrix. The roller 3 is adapted to draw an electrosensitive tape 4 from a storage reel 2 over a tensioning roller 17, a tape detector roller 18, a guide roller 19, and a roller 6 serving as a counter-electrode, the tape detector device 18 being designed for actuating a warning signal when tape 4 is completely unreeled. The tape 4 comprises an insulating carrier having a metallic coating thereon which forms a return path. The styli are disposed above the roller 3 in a straight line across the direction of the tape feed so as to lightly engage the metallised side of the tape under a pressure which may be adjusted by means of a shiftable weight 21, and the voltage applied to the stili in response to the electrical signals obtained from the matrix is such that the metallic layer at the point of contact of an energized stylus is vaporised by the current flowing therethrough.

FIG. 7 shows a bank of fifteen parallel printing styli of which nine adjacent styli are disposed for printing the coded representation of each input character in a legible form, and of which three styli such as shown at 25 and 26 are disposed at each side of said nine styli for printing directly transmitted ticket identifying code dots along two marginal portions of the tape. All the styli are mounted on a support fixed in position by means of screws 29 and 30, and are provided with printed circuits for connecting each stylus to a terminal such as 27 or 28 which, in turn, is connectable to a corresponding printing wire leading to the matrix.

An alternative construction of a styli support is shown in FIG. 8 in which the styli such as 26, 26' are carried by two plates 31 and 31' secured by means of screws 33 to a V-shaped support 34, and are connected to terminals such as 27, 27' for the printing wires such as 32 and 32'. This construction permits a more precise alignment and more spacing of the styli heads.

Figure 9:
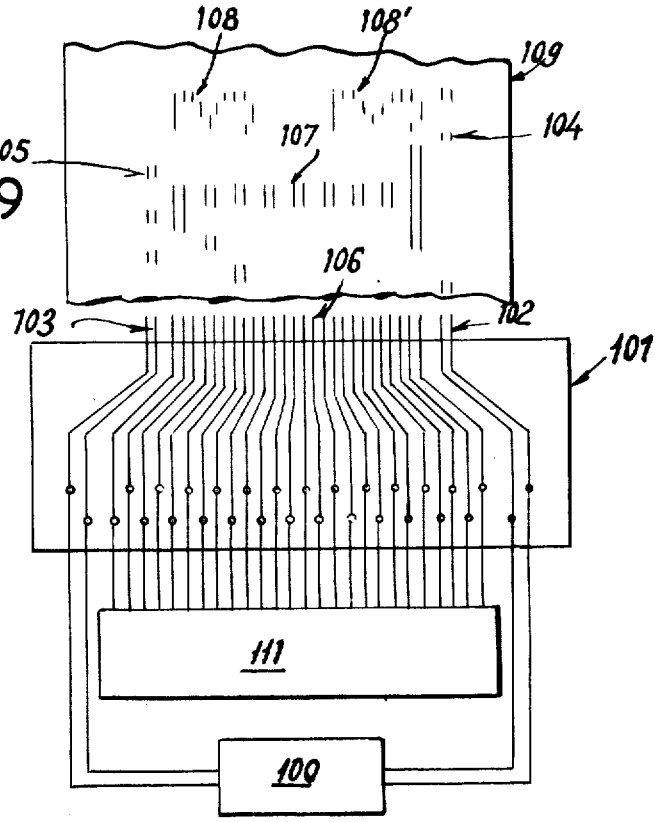
FIG. 9 shows another convenient form of printing head.
Figure 10:
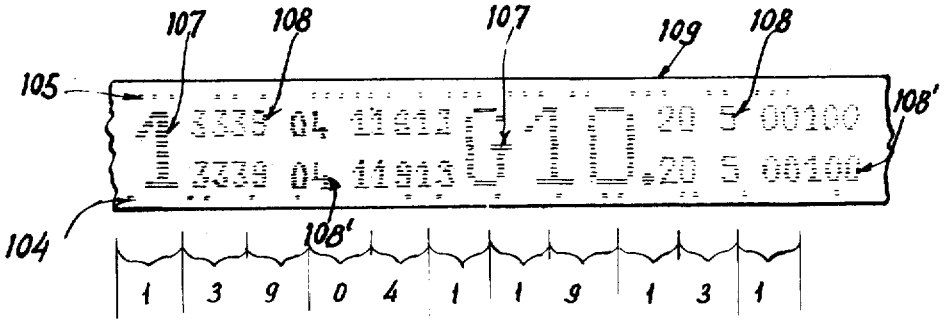
FIG. 10 shows a typical printed betting ticket.

The printing head 101 shown in FIG. 9 is particularly suitable for printing a ticket such as the betting ticket 109 shown in FIG. 10. The printing head 101 comprises 13 adjacent pairs of printing styli 106 which may be energized through the printing wire operators of a selective type size matrix 111 having 13 sweep lines such as shown at 35, 36 in FIG. 3, to print the large characters indicated at 107 and the small characters indicated at 108 and 108' (FIG. 10). The printing head 101 also includes two pairs of printing styli 102 and 103 one pair at each side of the group formed by the styli 106. The styli 102 and 103 are energizable through a pulse generator 100 included in the processor 302 and adapted to provide with a simple binary code, a set of identifying pulses corresponding to the legible characters printed by the styli 106 and reproduced by the styli 102 and 103 in the form of two marginal rows of bits 104 and 105. The brackets represented in FIG. 10 below the ticket 109 indicate the group of four bits 104 and 105 corresponding to the legible characters successively printed on the ticket 109. Thus, the first group of identification bits corresponds to the number 1.

The first group of bits corresponds to the numeral 1, which is the first from the left on the ticket 109. This number 1 is represented in binary code by 1,0,0,0 on row 104, while the group of corresponding bits of row 105 is complementarily coded 0,1,1,1. The second and third groups of bits of row 104 correspond to the numbers 3 and 9 which are the last of the first group of small characters selected from the left on ticket 109. They are translated respectively into binary by 1,1,0,0 and 1,0,0,1. To these bits there corresponds on row 105 the code 0,0,1,1 and 0,1,1,0.

The same is true for the following numbers of the row of bits 104, for example, 0,4,1,1,9,1,3. The last number 1 to the right on the row of bits 104 is a translation into code of the letter G of document 109.

Thus the sum of the number of bits taken from row 104 added to the sum of the number of bits taken from row 105 must be the multiple by 4 of the number of the coded numeral on the marginal row, for example, 44 in this example.

The legible characters printed on the 109 represent from left to right the following informations: 1 is the race number; 3339 is the code for the day; 04 is the number of the vending station or ticket selling booth, 11913 is the serial number of the ticket; G is the denomination of the bet (for example win pool); 10 is the competitor's number; 20 is the number of money transaction units involved; 5 is the unitary value of the transaction; and 100 is the total amount of the transaction or stake.

Figure 11:
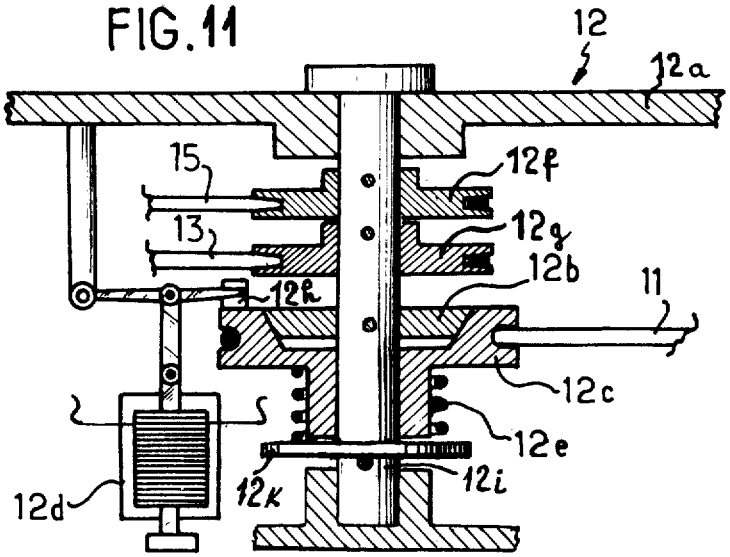
FIGS. 11 and 12 show details of parts of the ticket printing and issuing machine shown generally in FIG. 6.

FIG. 11 shows the clutch device 12 of FIG. 6 as comprising a support plate **12*a* for a rotatably mounted shaft 12*i* provided with a driven clutch member in the shape of a wheel 12*b* having a beveled peripheral face adapted to be engaged by the correspondingly shaped inner side of a driving clutch member also in the shape of a wheel 12*c* mounted to turn loosely and to slide longitudinally on shaft 12*i*. The wheel 12*c* is pressed on its outer face by a spring 12*e* coiled on the hub of wheel 12*c* and abutting on a washer 12*k* mounted on the shaft. Thus the spring 12*e* serves to hold the driving clutch member 12*c* in frictional contact with the peripheral face of the driven clutch member 12*b*. Two further wheels 12*f* and 12*g* are secured to shaft 12*i* for rotation therewith and these wheels as well as wheel 12*c* are made in the form of a pulley permitting to connect the reduction gear 10 to wheel 12 through belt 11, to connect wheel 12*g* through belt 13 to disc 14 of the synchronising device, and to connect wheel 12*f* through belt 15 to the tape feed roller 3 (FIG. 6). In order to move the driving clutch member 12*c* out of frictional engagement with the driven clutch member 12*b*, a friction-roller 12*h* adapted to engage the inner side of member 12*c* is journaled on the free end of a pivotally mounted arm linked to an electromagnet 12*d* the energization of which causes the friction-roller 12*h* to move into engagement with the driving clutch member 12*c* to shift the latter out of frictional contact with the driven clutch member 12*b* and thereby interrupt the drive transmission from motor 9 to roller 3 and disc 14**.

Figure 12:
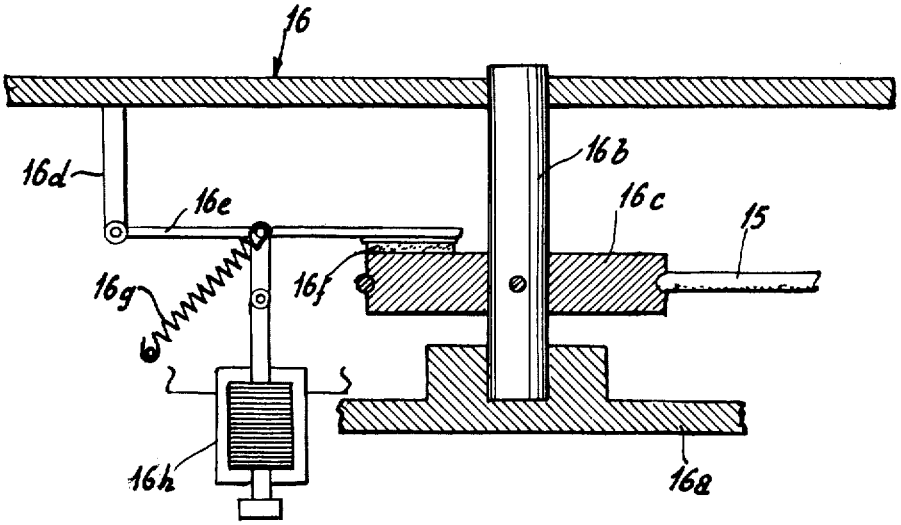
Figure 13:
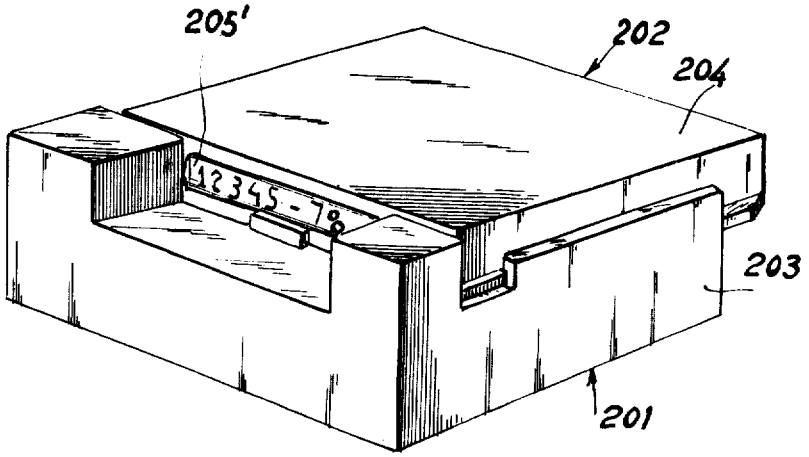
FIG. 13 is a perspective view of the cash printing, recording and displaying machine.
Figure 17:
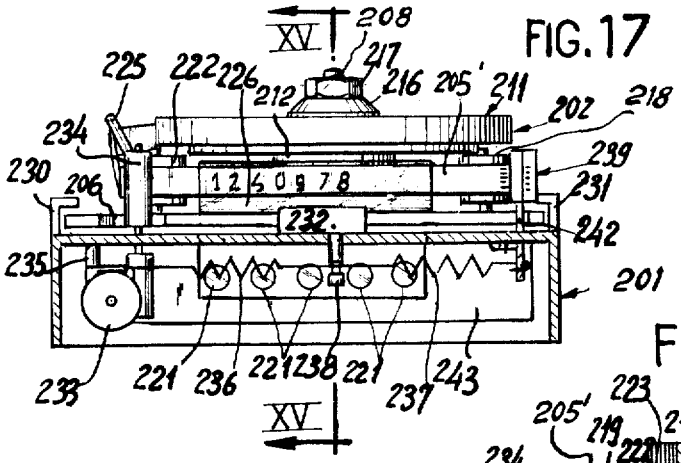
FIG. 17 is a sectional view taken along line XVI XVI of FIG. 14.
Figure 15:
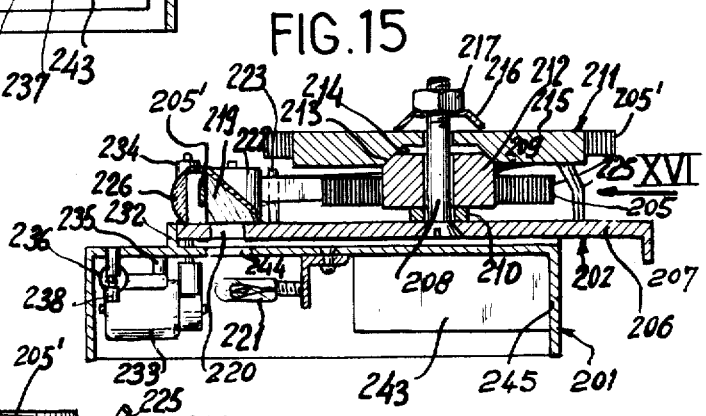
FIG. 15 is a sectional view taken along line XIV—XIV of FIG. 14.
Figure 16:
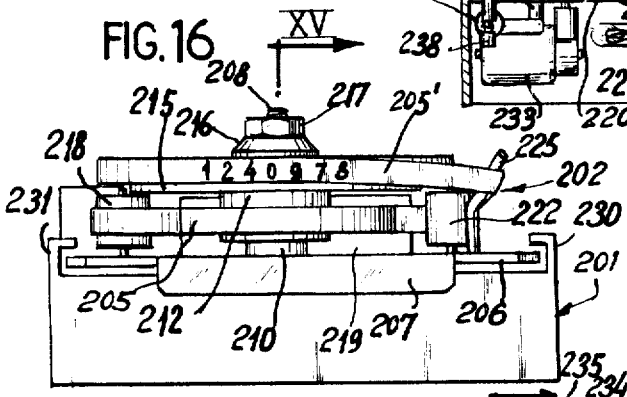
FIG. 16 is a sectional view taken along line XV—XV of FIG. 15.
Figure 14:
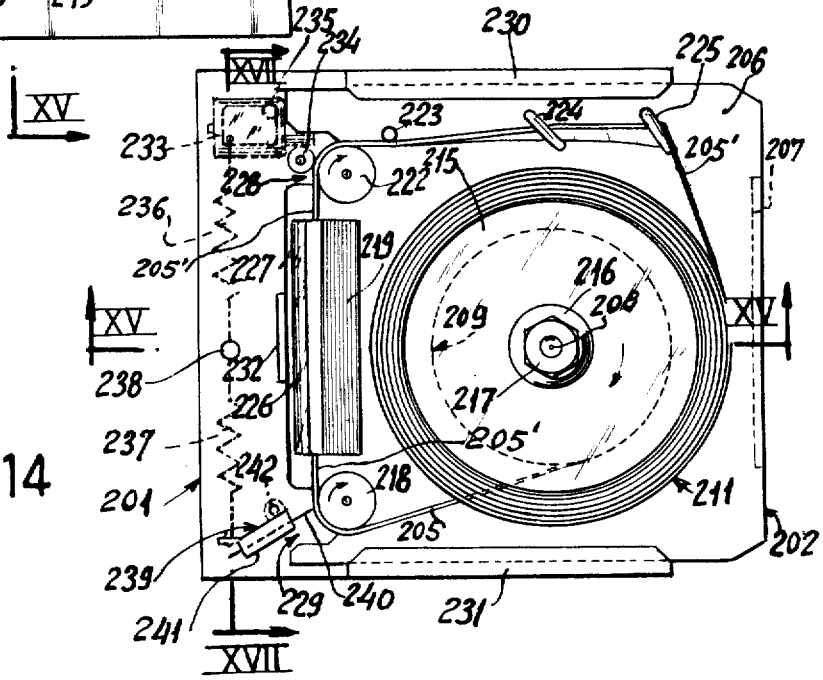
FIG. 14 is a plan view of the machine shown generally in FIG. 13.

The FIG. 12 shows the braking device of FIG. 6 as comprising a support **16*a* for a rotatable shaft 16*b* having a pulley shaped roller 16*c* mounted thereon. The transmission belt 15 (FIG. 6) is trained over the roller 16*c* the upper annular face of which is adapted to be engaged by a brake shoe provided with a facing 16*f* of suitable frictional material. The brake shoe is mounted on one end of an arm 16*e* which is pivotally connected at its other end to a support 16*d*. A spring 16*g* attached at one end to arm 16*e* normally retains the brake shoe in spaced position from the upper annular face of roller 16*c*, and the arm 16*e* is connected through a linkage to an electromagnet 16*h* which is effective, when energized, to move the brake shoe against the action of spring 16*g* into engagement with the roller 16*c* to retard the revolution thereof and thereby cause the roller to apply resistance to the motion of transmission belt 15**.

For severing each completely printed ticket from tape 4, the ticket printing and issuing machine 1 disclosed in FIG. 6 further comprises a cutting device 20 including a movable cutter member 7 arranged to cooperate with a stationary cutter member 7' disposed between the tape feed roller 3 and a tape outlet 8 of the machine. The movable cutter member 7 is connected to an electromagnet 24 which, when energized, moves the movable cutter member 7 in the cutting direction thereof, and the tape 4 is arranged over the roller 3 so as to move between the cutter members 7 and 7' towards and through the outlet 8 of the machine.

The disc 14 of the synchronising device is provided with circumferentially spaced scanning apertures designed to operate as a component of a conventional pulse generator arrangement (not shown) having the scanning apertures of disc 14 disposed between a light sensitive device such as a photo-electric cell and an exciter lamp suitably positioned with respect to a screen provided with a light slit for projecting a thin beam of light through the scanning apertures to the photo-electric cell. It will be understood that by this arrangement sharply defined synchronising pulses may be produced at a frequency of succession corresponding to the rotational speed of motor 9 and hence to the advance speed of tape 4, and that such pulses may be used for synchronising the scanning control of the previously described matrix and consequently the frequency of succession of the scan lines 39 (FIG. 3) with the advance speed of tape 4.

It will be understood that the electromagnet clutch device 12, the electromagnetic brake device 16, the electromagnetic cutting device 20, and the synchronising pulse generator 14 particularly disclosed herein are of illustrative character only and that other types of clutching mechanism, braking mechanism, cutting mechanism, and synchronising pulse generator arrangements may be employed.

The operating circuit for the motor 9 may be supplied with energy from a suitable source so as to run continuously while the machine is in use, the speed of motor 9 being adjustable by means of a rheostat 23. For operating the machine in continuous successive cycles of printing operation, the energizing circuits for the electromagnetic clutch 12, for the electromagnetic brake 16, and for the electromagnetic cutting device 20 may be supplied withe energy from said source through a control switch included in each of said three energizing circuits, the control switch for clutch 12 being normally closed so as to maintain the clutch between two successive cycles of printing operation in the disengaged position thereof, whereas the control switches for the brake 16 and for the cutting device 20 are normally open between two successive cycles of printing operation so as to maintain the brake 16 and the cutting device 20 in the operative position thereof. For initiating each cycle of printing operation, the data processor 302 (FIG. 1) is provided with electronic circuitry means adapted to produce upon a start impulsion received from the computer station 303 three successive electric signals the first of which is a cutter blade release signal applied to a first relay adapted to open the control switch for the cutting device 20 in response to said first signal to thereby separate the movable cutter blade 7 from the stationary cutter blade 7', the second signal being a brake release signal applied to a second relay adapted to close the control switch for the brake device 16 in response to said second signal whereby to release the brake, and the third signal being a clutch engaging signal applied to a third relay adapted to open the control switch for the clutch 12 in response to said third signal to thereby cause the driving clutch member **12*c* to engage the driven clutch member 12*b*. In order to operate the clutch device 12, the brake device 16, and the cutting device 20 in properly timed sequence, the duration of the third signal is slightly longer than the time required for printing all the successive characters corresponding to the particulars of a selected bet and may vary in accordance with the variable number of said characters so that the clutch device 12 is caused to transmit the drive from motor 9 to the tape feed roller 3 slightly before the printing of the first character, and to interrupt said drive transmission slightly after the printing of the last character. The duration of the second signal is slightly longer than that of the first signal so as to render the brake device 16 inoperative before the clutch device 12 becomes operative and to render the brake device 16 operative only after the clutch device 12 has become inoperative, and the duration of the first signal is slightly longer than that of the second signal so as to cause the movable cutter member 7 of the cutting device 20 to move out of the path of tape 4 before the brake device 16 becomes inoperative, and to move into the path of the tape 4 only after the brake device 16** has been rendered operative.

The above described ticket printing and issuing machine is capable of issuing at least three printed tickets of same or different length per second, and the issued tickets cannot be forged or falsified.

Since the binary coded data printed on the ticket is also readable by a conventional tape punch reader, the invention further contemplates to associate the ticket printing and issuing machine 1 with a high-speed printing machine arranged for recording and displaying the dividend to be distributed among the holders of winning tickets issued by the ticket printing and issuing machine 1.

Figure 2:
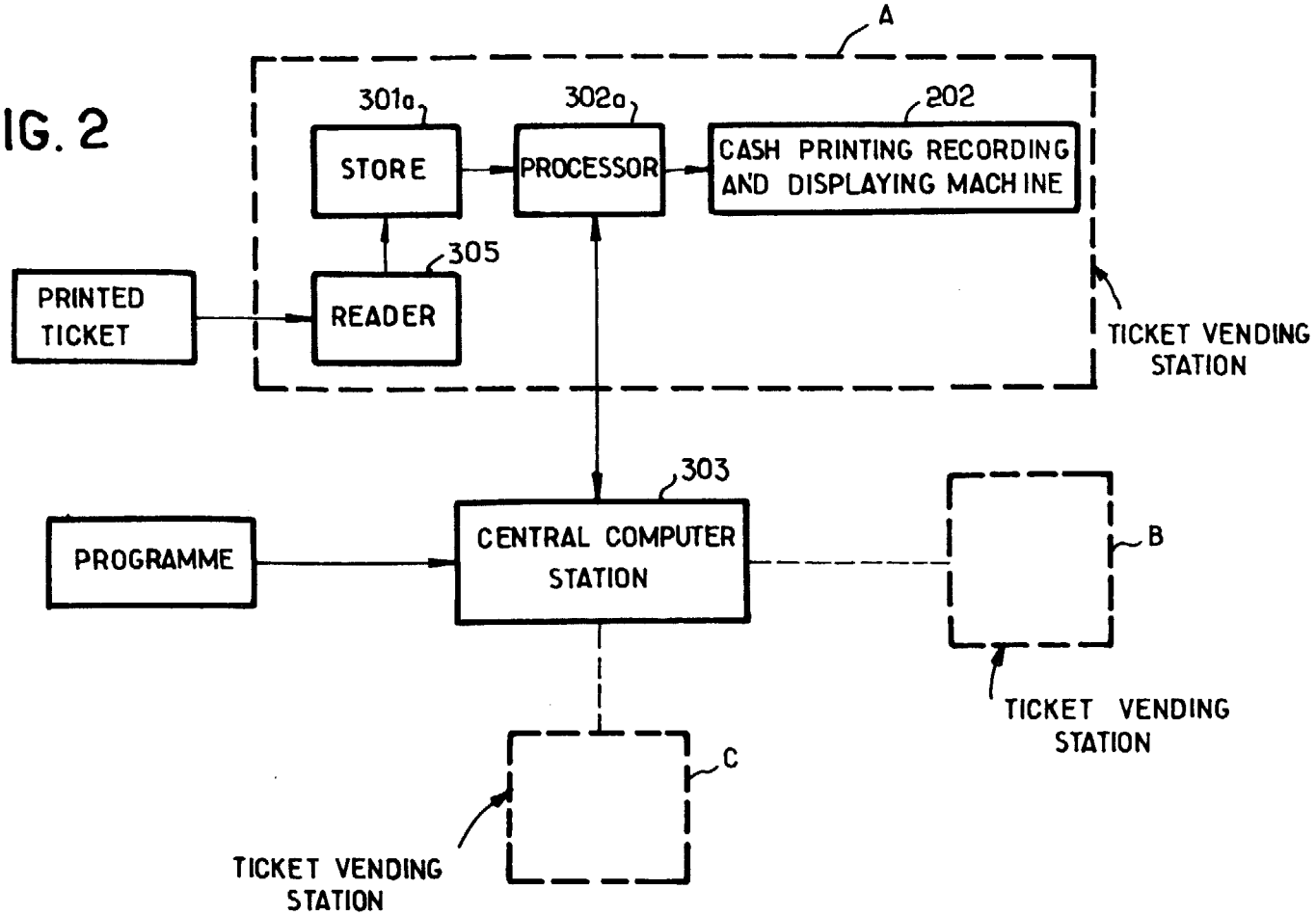

Therefore, and as shown in FIG. 2, each ticket vending station such as A in FIG. 1 may further comprise a conventional tape punch reader 305 adapted to read the binary coded data printed on the tickets issued by the ticket printing and issuing machine 1. The output from reader 305 is applied to a binary store **301*a*, and a processor 302*a* transmits the date taken from store 301*a* to the central computer station 303, which compares the data received from the processor 302*a* with the corresponding particulars of the already registered bet, which calculates the cash amount to be paid on the thus checked winning ticket, and which produces coded output signals corresponding to the successive characters of the calculated cash amount. Finally, the processor 302*a* transmits said coded output signals from the central computer station 303 through a matrix to a high-speed printing machine 202** adapted to print and to display the coded signals in the form of legible characters.

The cash printing, recording and displaying machine 202 is shown in FIGS. 13 to 17 as comprising a fixed part 201 enclosed in a cover 203 and a removable cassette 204. On the front of the apparatus, the printed tape 205' appears in a window.

The cassette 204 comprises a platen 206 having a grasping and handling edge 207 on its rear portion. Onto a shaft 208 perpendicular to the platen 206 there is passed, in a freely-rotating manner, a supply reel 209 of electrosensitive tape 205'. The reel 209 carries a take-up reel 211 for the printed tape 205'. The hub 212 of the supply reel 209 has on its upper portion a conical part 213 fitting frictionally inside a conical cavity 214 in the hub 215 of the take-up reel 211. A resilient washer 216, clamped by a nut 217 on the shaft 208, resiliently biasses one reel while a washer 210 interposed between the hub 212 of the supply reel 209 and the platen 206 permits free rotation of the reels on the shaft 208. The tape 205' passes from supply reel 209 over a conductive printing drum 218 and past a total-reflection prism 219 which is arranged above an opening 220 exposed to the light produced by a series of lamps 221 disposed in the fixed part 201, to a drum on a free-wheeling capstan 222, and then over guide pins 223, 224, 225 to the take-up reel 211.

In front of the prism 219 there is arranged a magnifying lens 226, a passage of sufficient width being provided between the lens 226 and the prism 229 to allow the tape 205' to pass without rubbing. On the other side of the edge 207, the platen 206 has a frontal part 227 and two tappings 228 and 229 for admitting the motor unit of the capstan 222 and printing stations 239, respectively.

Cassette 204 is guided in the fixed part by two lateral slides 230 and 231 and bears against an alentment 232 formed on the fixed part 201 which encloses a motor 233 for driving a capstan roller 234. The motor-roller assembly is pivotally mounted on an axis 235, and a spring 236 resiliently applies the roller 234 on the capstan drum 222 in the cassette 204. Another spring 237 fixed on the same pin 238 as spring 236 resiliently applies a printing head 239 against the tape 205' passing over the printing drum 218 mounted on platen 202. The printing head 239 is made up of nine printing electrodes 240 insulated from one another and arranged on a support which is pivotable about an axis 242. The electrodes 240 are connected independently of one another by printing wires (not shown) to operators 243 having an input from a dot matrix such as shown in FIG. 3.

The lamps 221 for illuminating the prism 219 are arranged below an opening 244 in the frame 245 of the fixed part 201, opposite the opening 220 in the platen of the cassette 202.

The tape to be printed 205, stored on the reel 209, is driven by the capstans 234, 222 at a constant speed and tension in front of the luminous strip lit by the bulbs 221. The printed tape is then guided by pins 223, 224, 225 towards the take-up reel 211. The diameter of reel 209 is always smaller even when full than the diameter of the empty take-up reel 211. The tape 205 thus rotates the hub 212 of the reel 209 which itself frictionally drives hub 215 of the take-up reel 211. By virtue of the difference in diameter between the reels 209 and 211, the peripheral speed of the reel 211 is greater than that of the reel 209. Thus, for the same angle of rotation of both reels 209 and 211, the reel 209 delivers a quantity of tape 205 which is less than the reel 211 can take up. There is therefore a slippage between the hubs 212 and 215 of the reels 209 and 211, and the tape is kept constantly under tension. When the tape 205 moves past the printing head 239, it is marked by the electrodes 240 in accordance with the pulses received from the operators 243. The thus marked tape passes along the prism 219 which, illuminated from below by lamps 221, forms a luminous strip and the image of the printed tape 205' is magnified by the lens 239 and is thus easily readable by an observer in front of the printer.

The cassette 204 may be replaced at any moment by another, similar one and such cassettes are easy to make at low cost, and they are easily stored. The fixed part 201 of such a printer is also easy to make in a robust form and it encloses all the heavy units of such a printer.

The just described cash printing, recording and displaying machine may be provided with any suitable pulse generator arrangement such as described with reference to FIG. 6 for producing synchronising pulses at a frequency of succession corresponding to the rotational speed of motor 233, such pulses being used for synchronising the matrix scanning control incorporated in the processor 302*a* with the advance speed of the tape 205.

While the invention has been particularly shown and described with reference to some preferred embodiments thereof, it will be understood by those skilled in the art that various changes in form and details may be made therein without departing from the spirit and scope of the invention.

Thus, the cash amount displaying means of the cash printing machine 202 may comprise a display arrangement which can energize a cathode ray tube to display the cash amount corresponding to each successively processed winning ticket on its screen in a legible form. The ticket printing and issuing machine as well as the cash printing and displaying machine may comprise two identical sets of components for alternately advancing and printing two separate tapes, and automatically actuated switch means for interrupting the operation of one set and rendering the other set operative when the tape printed by said one set is completely unreeled.

What we claim is:

1. In an electronic system which handles input data representing the particulars of transactions such as wager transactions according to a corresponding transaction program and which is of the type comprising a plurality of ticket vending stations at different locations with each of the vending stations storing the input data, processing the input data in the form of coded characters, and printing and issuing a ticket under control of a computer provided at a central station which incorporates the program and receives the coded characters from the vending stations, the improvement wherein: processor means are provided at each vending station for writing said coded characters in a dot matrix having a predetermined number of writing elements arranged in mutually perpendicular scan and sweep lines; and wherein each vending station is further provided with a controllable means for feeding electrosensitive tape in a continuous manner past a printing head through each successive cycle of printing operation, the duration of each cycle of printing operation and the length of the electrosensitive tape so fed being dependent upon the number of coded characters to be printed and thus the complexity of a transaction; an assembly of printing electrodes representing said sweep lines of said matrix and being disposed at the printing head across the direction of feed of said tape, said electrodes being operable through said matrix as the tape is fed past the printing head to print the successive matrix characters on the tape in the form of legible characters representative of the particular transaction; and means operable at the end of each printing cycle for severing that length portion of the tape which has been printed from the unprinted part thereof to thereby provide a printed ticket serving as a valid voucher for a properly registered transaction.

2. The system according to claim 1, wherein said means for severing the printed tape length at the end of each cycle of printing operation comprises a movable cutter blade and electromagnet effective when energized to move said cutter blade into the path of the tape, and wherein said means for feeding the electrosensitive tape past said printing head in a continuous manner through successive cycles of printing operation comprises a motor, a tape feed roller, an electromagnetic clutch operative to transmit the rotary motion of said motor to said roller and effective, when energized, to interrupt the drive transmission from said motor to said roller, and an electromagnetic brake operative to produce a braking action for said tape feed roller and effective, when energized, to release said braking action, and wherein each vending machine includes circuit means operable to produce upon a start impulse received from the computer station three successive electric signals causing respectively said cutter blade actuating electromagnet, said electromagnetic clutch, and said electromagnetic brake to operate in properly timed sequence at the beginning as well as towards the end of each complete printing cycle.

3. The system according to claim 1, wherein each ticket vending station is further provided with an electronic ticket reader adapted to read the data printed on a ticket issued by the ticket printing and issuing machine in any ticket vending station, a computer controlled processor means for processing and checking the read data in the form of coded characters, for producing coded output signals corresponding to the successive characters of the cash amount to be paid on each winning ticket presented to said reader, and for writing said signals in the form of coded characters in a dot matrix having said predetermined number of writing elements arranged in mutually perpendicular scan and sweep lines, and a cash printing recording and displaying machine having controllable means for feeding electrosensitive recording tape in a continuous manner past a printing head through each successive cycle of printing operation, and an assembly of printing electrodes representing the sweep lines of said matrix and disposed at the printing head across the direction of feed of said tape, said electrodes being operable through said matrix as the tape is fed past the printing head to print the successive matrix characters on the tape in the form of legible characters.

4. The system according to claim 3, in which said cash printing recording and displaying machine incorporates a casset containing a rotatable supply spool for said electrosensitive recording tape, and a rotatable take-up member mounted in co-axial relationship to said recording tape supply spool and having a diameter greater than that of said recording tape spool, a frictional drive connection between said recording tape spool and said take-up member, means for guiding the recording tape from said spool to said take-up member, said guide means including a pair of cooperating rollers adapted to resiliently clamp said recording tape therebetween, a motor, a drive connection between said motor and one of said cooperating rollers, said one roller being effective when rotated by said motor to draw the recording tape from said supply spool and thereby cause the latter to rotate said take-up member through said frictional drive connection, and wherein the casset includes a transparent portion such as to render the characters printed by said electrodes on the tape visible from the outside of said casset.

5. The system as defined in claim 1, wherein said printing head further includes electrodes disposed at a location adjacent the margin of said electrosensitive tape so as to additionally print coded information along the margin of said tape which bears a representative relationship to the legible printed characters.

* * * * *